United States Patent [19]

Mizoguchi et al.

[11] Patent Number: 5,065,812

[45] Date of Patent: Nov. 19, 1991

[54] PROCESS FOR THE TWIN-ROLL TYPE, CONTINUOUS CASTING OF METAL SHEETS

[75] Inventors: Toshiaki Mizoguchi; Kenichi Miyazawa, both of Futtsu, Japan

[73] Assignee: Nippon Steel Corporation, Tokyo, Japan

[21] Appl. No.: 578,305

[22] Filed: Sep. 5, 1990

[30] Foreign Application Priority Data

Sep. 11, 1989 [JP] Japan ..... 1-232910

[51] Int. Cl.[5] ..... B22D 11/06

[52] U.S. Cl. ..... 164/480; 164/428

[58] Field of Search ..... 164/428, 480

[56] References Cited

FOREIGN PATENT DOCUMENTS 52-23327 6/1977 Japan .
58-148056 9/1983 Japan .
59-33059 2/1984 Japan .
60-21161 2/1985 Japan .
61-30260 2/1986 Japan .
61-186153 8/1986 Japan .
62-61349 4/1987 Japan .

*Primary Examiner*—Kuang Y. Lin
*Attorney, Agent, or Firm*—Wenderoth, Lind & Ponack

[57] ABSTRACT

Twin-roll type, continuous casting of metal sheets is carried out by pouring a molten metal into the clearance between a pair of rolls, provided with control plates, respectively, and rolling the poured molten metal while solidifying the poured molten metal, under a condition given by:

$$u \geqq d/a$$

wherein u is a roll surface speed (m/sec), d is a thickness of the lower edge of each of control plates (mm) and a is a coefficient depending upon the species of molten metal, thereby producing cast pieces in a sheet form.

6 Claims, 5 Drawing Sheets

FIG.3(a)
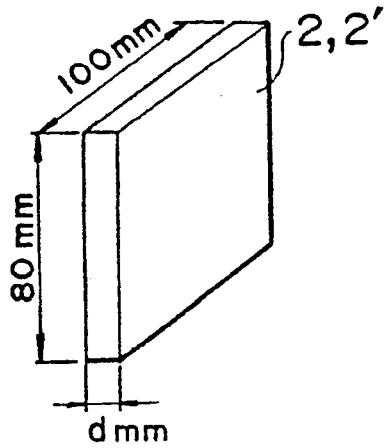
FIG.3(b)
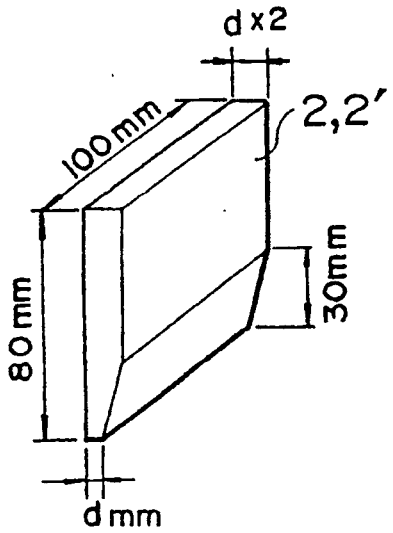
FIG.3(c)
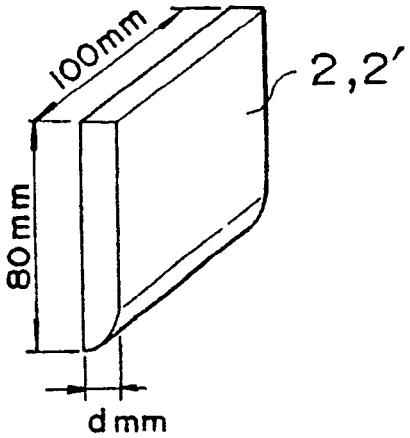
FIG.3(d) FIG.3(f)
FIG.3(e)
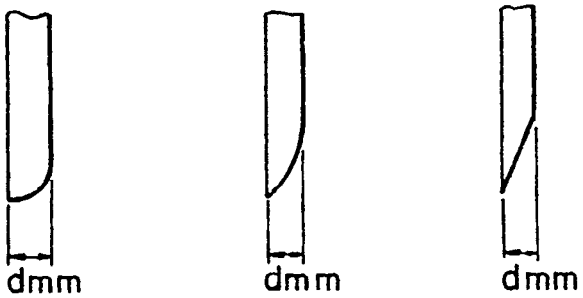

PROCESS FOR THE TWIN-ROLL TYPE, CONTINUOUS CASTING OF METAL SHEETS

BACKGROUND OF THE INVENTION (1) Field of the Invention

This invention relates to a process for the twin-roll type, continuous casting of metal sheets, which produces cast metal pieces in a sheet form directly from a molten metal.

(2) Prior Art

A process for producing cast metal pieces in a sheet form, which comprises pouring a molten metal into the clearance between a pair of rotating rolls, solidifying the poured molten metal and rolling the solidified metal, is known as Bessemer process. The cast metal pieces obtained according to the process have a thickness of a few millimeters, and are very thin, as compared with the steel ingots and continuously cast slabs produced according to the conventional process, and thus cannot have a higher draft when cold rolled. That is, cast surface state, particularly surface wrinkling and cracking, of cast metal pieces is an important problem. That is, it is important to control the surface state of cast metal pieces with a high precision.

In order to improve the surface state of cast metal pieces, it was attempted to improve a casting nozzle to gently supply a molten metal into the clearance between the rolls and minimize fluctuation at the meniscus, which becomes a cause for the wrinkling at the cast surfaces of cast metal pieces, as shown in Japanese Patent Publication No. 52-23327, etc. However, it is difficult in these prior art processes to completely eliminate the fluctuation of the surface of molten metal at the meniscus and also to flatten the cast surfaces of cast metal pieces.

In order to solve the problem of pouring a molten metal on the other hand, it was attempted to start formation of solidified shell below the meniscus of molten metal, thereby improving the surface state of cast metal pieces, as shown in Japanese Patent Applications Kokai (laid-open) Nos. 61-30260 and 61-186153.

Furthermore, it was also attempted to provide control plates in the pool of molten metal formed between a pair of rolls to adjust the contact area between the molten metal and the rolls and control a position of beginning of a solidification under the surface of the molten metal, thereby rectify fluctuation in the thickness of cast metal pieces and making the surface state of the cast metal pieces good, as disclosed in Japanese Patent Applications Kokai (Laid-open) Nos. 58-148056, 59-33059 and 60-21161, and Japanese utility Model Application Kokai (Laid-open) No. 62-61349.

However, it is difficult in these prior art processes to completely prevent wrinkling or cracking at the surfaces of cast metal pieces under every casting conditions.

SUMMARY OF THE INVENTION

An object of the present invention is to provide a process for the twin-roll type, continuous casting of metal sheets using control plates, which can produce cast metal pieces in a good surface state completely free from wrinkling or cracking.

Another object of the present invention is to provide a process for the twin-roll type, continuous casting of metal sheets using control plates, which can readily produce cast metal pieces in a sheet form having a good surface state by ensuring a uniform contact between the rolls and the molten metal in the casting direction as well as in the width direction of cast metal pieces.

Other object of the present invention is to provide a process for the twin-roll type, continuous casting of metal sheets, which can produce cast metal pieces in a sheet form with an improved quality while solving the problems of generation of wrinkling or cracking of cast metal pieces as the largest drawbacks of cast metal pieces obtained by the conventional twin-roll type processes.

The present invention provides a process for the twin-roll type, continuous casting of metal sheets, which comprises supplying a molten metal into the clearance between a pair of rolls, each of which rolls is provided with a control plate, solidifying the supplied molten metal and rolling the solidified metal, thereby producing cast pieces in a sheet form, the casting being carried out under the condition given by the following equation (1):

$$u \geqq d/a \qquad (1)$$

wherein u is a roll surface speed (m/sec), d is a thickness of the lower edge of each of the control plates (mm) and a is a coefficient depending upon the species of molten metal.

The twin-roll type for use in the present invention can be any of vertical type, inclined type, different-diameter type, etc., though their casting types are different from one another.

BRIEF DESCRIPTION OF THE DRAWINGS

FIGS. 3(*a*), 3(*b*) and 3(*c*) are perspective views of examples of the control plates according to the present invention.

FIGS. 3(*d*), 3(*e*) and 3(*f*) are partial fragmentary side views showing examples of the shape of the lower edge of the control plate according to the present invention.

FIG. 6(*b*) is a sketch of a photograph showing the surface state of SUS304 cast piece produced according to one comparative example.

FIG. 7(*b*) is a sketch of a photograph showing the surface state of cast piece of Fe-3 wt. % Si alloy produced according to another comparative example.

DESCRIPTION OF THE PREFERRED EMBODIMENTS

The present invention will be described in detail below, also referring to the functions of the present invention.

Figure 1:
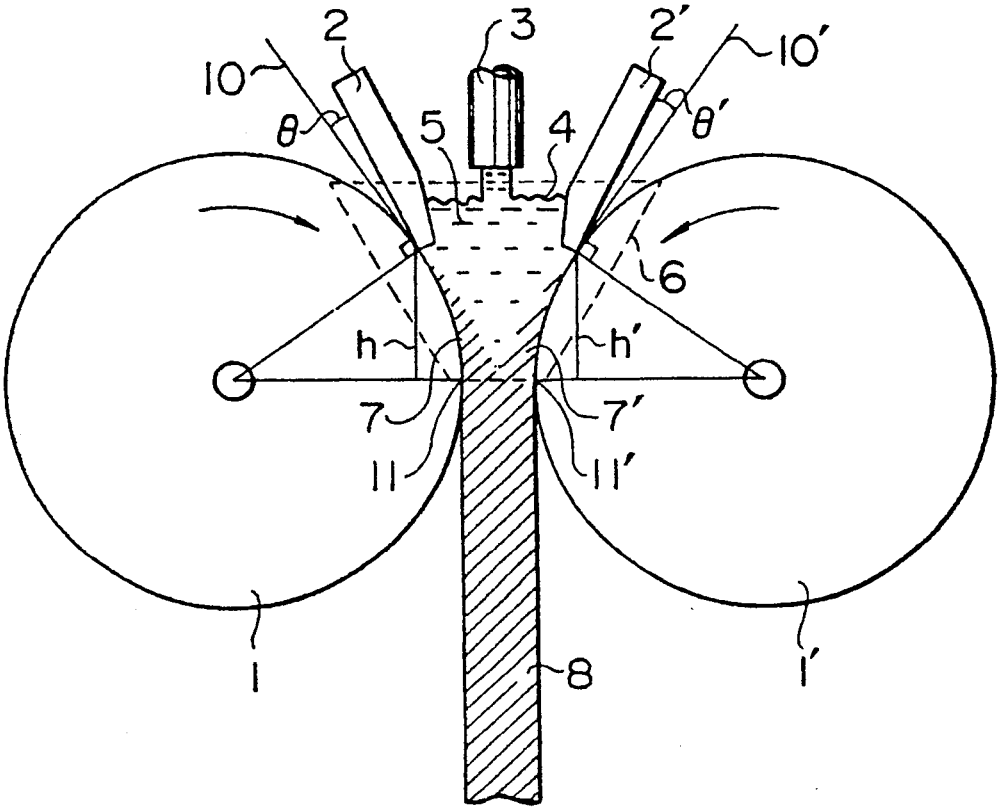
FIG. 1 is a side view showing one example of a twin-roll type, continuous sheet casting machine to which the present invention is applied.

FIG. 1 is a side view showing one example of a twin-roll type, continuous sheet casting machine to which the present invention is applied.

Control plates 2 and 2' are attachments for controlling the contact area between molten metal 5 and rolls 1 and 1', and for controlling the beginning of solidifying shells 7 and 7' below the molten metal surface, and are so provided that the lower edge parts of control plates 2 and 2' may be brought into a close contact with the two rolls 1 and 1', respectively. During the rotation of rolls 1 and 1', the roll surfaces slide over the lower edge parts of control plates 2 and 2', respectively. The control plates 2 and 2' also play a role of removing slags, oxides, etc. floating on the surface of meniscus 4 and peeling the solidified products, as attached to the roll surfaces, from the roll surfaces. Materials for control plates 2 and 2' are preferably materials of poor heat conductance, for example, refactories or ceramics such as $Al_2O_3$, BN, MgO, CaO, SiN, SiC, etc., but are not particularly limited. In order to prevent the solidification and adhesion of molten metal to the surfaces of control plates 2 and 2', it is desirable to heat the dip parts of control plates, that is, parts of control plate to be dipped into the molten metal pool, before the casting operation. The dip depth of control plates 2 and 2' in the molten metal pool, that is, the depth of dip parts, is adjusted by a range of fluctuation of meniscus 4 on the surface of molten metal pool. The later mentioned, dip angles of control plates 2 and 2' in the molten metal pool, that is, $\theta$ and $\theta'$ shown in FIGS. 1 and 2, can be angles used in the ordinary conventional casting operation.

The present inventors found in tests of twin-roll type, continuous casting of metal sheets using control plates that cast pieces in a good surface state were not always produced and thus further investigated causes for wrinkling or cracking of cast metal pieces by conducting the following tests using a twin-roll type, continuous sheet casting machine shown in FIG. 1.

Figure 2:
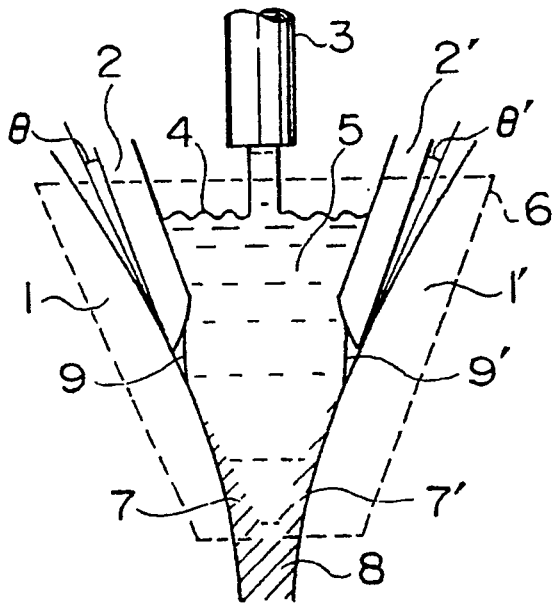
FIG. 2 is an enlarged view of the clearance between the rolls in FIG. 1, where a free molten metal surface is formed in the vicinity of the tip of each of control plates.

Commercially available austenite system stainless steel (SUS304) was heated and melted in an Ar gas atmosphere in a melting furnace of high frequency induction heating type and adjusted to a temperature of 1,510° C., and then the molten metal was supplied into the clearance between a pair of roltating rolls 1 and 1', made of copper alloy (diameter: 300 mm and width: 100 mm), provided with control plates 2 and 2', respectively, whose lower edge parts were brought into close contact with the rolls 1 and 1', respectively, in such a manner that, as shown in FIGS. 1 and 2, an angle $\theta$ or $\theta'$ composed of the control plate 2 or 2' and a tangent 10 or 10' at the surface of the roll 1 or 1', that is, a dip angle $\theta$ or $\theta'$, was set at not less than 0° in a state such that the control plate 2 or 2' was not brought into contact with a pouring nozzle 3, thereby to produce continued metal sheets.

In addition, as shown in FIG. 1, a height h or h' of the lower edge part of the control plate 2 or 2', which is determined on the basis of the point 11 or 11' of one roll 1 or 1' nearest to another roll 1' or 1, that is, a contact height h or h' of the lower edge part of the control plate 2 or 2' brought into close contact with the one roll 1 or 1', was set at 20~150 mm. The upper limit (150 mm) was determined by a radius of the roll, whereas as for the lower limit (20 mm), such a value was determined as a range such that an operation for setting is possible though an interval of the rolls is narrow. That is, it is preferable that h or h' satisfies the following equation:

$$20 \text{ mm} \leqq h \text{ or } h' \leqq \text{radius of the roll.}$$

On the other hand, as shown in FIGS. 3(*a*), 3(*b*) and 3(*c*), three kinds of control plates were used as shapes of control plates 2 and 2'. In addition, in order to form a molten metal pool at the clearance between the rolls 1 and 1' and ensure the control plate 2 and 2' a sufficient dip depth (about 5 to about 50 mm), side dams 6 were provided on both sides of rolls 1 and 1', as shown in FIG. 1. The thickness of the lower edge of each of control plates 2 and 2' and the roll surface speed were changed variously in the ranges of 1 to 10 mm and 0.15 to 1.4 m/sec, respectively, as operating conditions.

Figure 4:
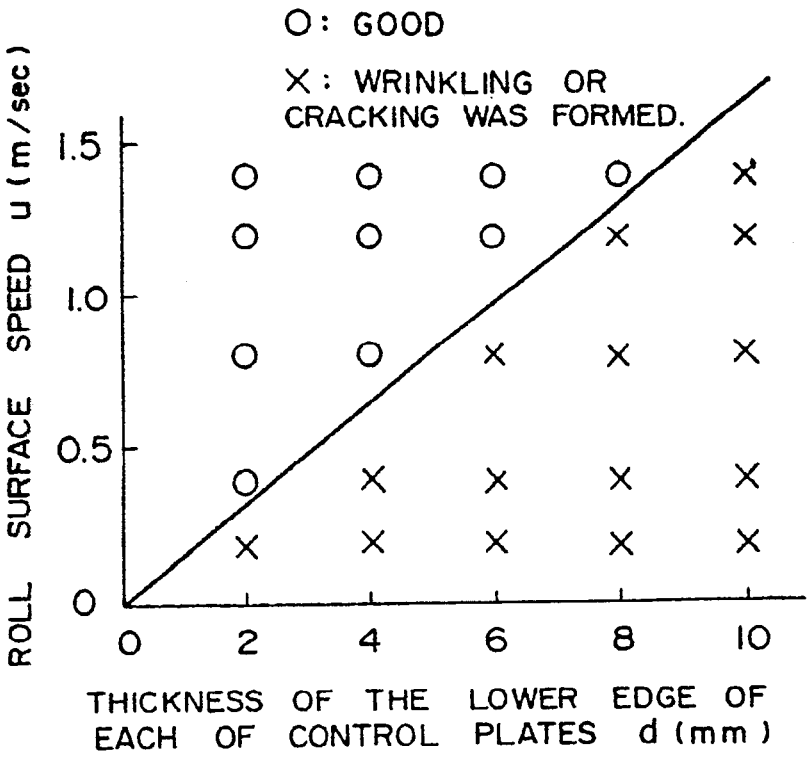
FIG. 4 is a diagram showing an influence of relations between the thickness of the lower edge of each of control plates and the roll surface speed upon the surface state of cast pieces of SUS304 steel.

Influences of relations between the thickness of the lower edge of each of control plates 2 and 2' and the roll surface speed upon the surface state of cast metal pieces are shown in FIG. 4.

Under the condition for the roll surface speed u(m/sec) given below, cast metal pieces in a good surface state were obtained:

$$u \geqq d/6.3 \quad (2)$$

wherein d is a thickness of the lower edge of each of control plates 2 and 2'(mm).

Figure 6A:
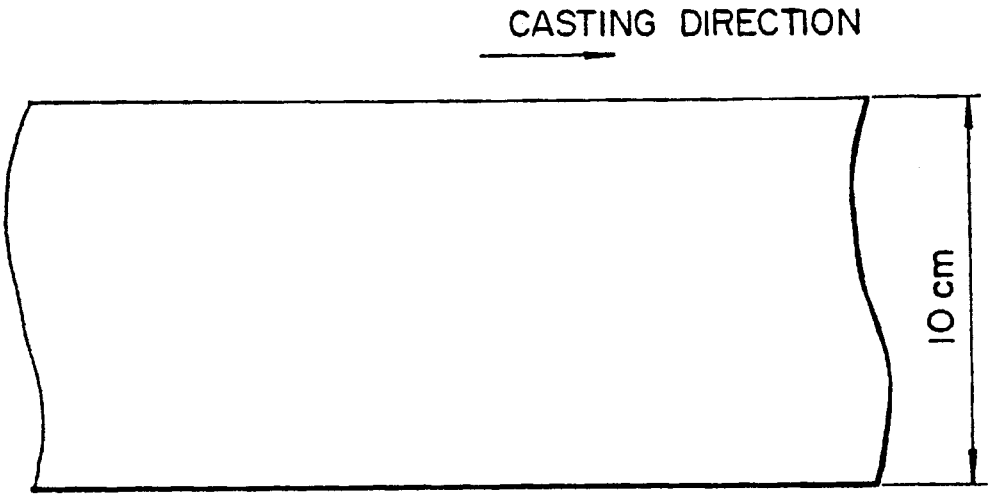
FIG. 6(*a*) is a sketch of a photograph showing the surface state of SUS304 cast piece produced according to one example of the present invention.
Figure 6B:
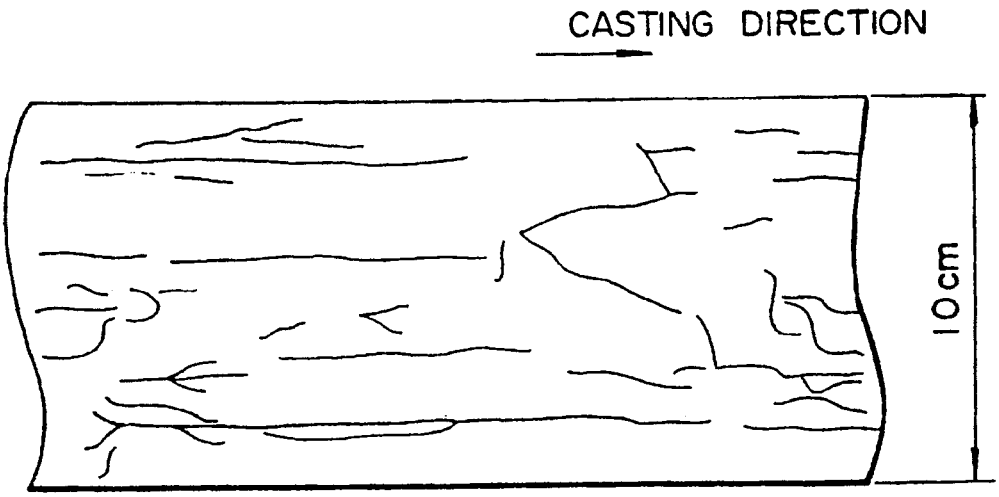

FIGS. 6(*a*) and 6(*b*) show sketches of photographs (scale: ½) showing the surface states of SUS304 cast pieces obtained in the above-mentioned tests. That is, FIG. 6(*a*) shows an example of cast piece with a flat and smooth surface, whereas FIG. 6(*b*) shows a comparative example of cast piece with a wrinkled surface. Under the casting condition satisfying the equation (2), cast metal pieces with a flat and smooth surface as shown in FIG. 6(*a*) were obtained.

It was found that the dip angles $\theta$ and $\theta'$ of control plates 2 and 2' in the molten metal pool, the contact height h or h' of the lower edge part of the control plate 2 or 2' which is determined on the basis of the point 11 or 11' of one roll 1 or 1' nearest to another roll 1' or 1, the shapes of the lower edges of control plates 2 and 2' and the dip depth of control plates 2 and 2' had no effect upon the surface state of cast metal pieces.

Then, an alloy consisting of Fe-3 wt. % Si and inevitable impurities was heated and melted in an Ar gas atmosphere in a melting furnace of high frequency induction heating type and adjusted to a temperature of 1,590° C., and then the molten metal was supplied into the clearance between a pair of rotating rolls 1 and 1', made of copper alloy (diameter: 300 mm and width: 100 mm ), provided with control plates 2 and 2', respectively, whose lower edge parts were brought into close contact with the rolls 1 and 1', respectively, in such a manner that a dip angle $\theta$ or $\theta'$ composed of the control plate 2 or 2' and a tangent 10 or 10' at the surface of the roll 1 or 1' was set at not less than 0° in a state such that the control plate 2 or 2' is not brought into contact with a pouring nozzle 3, thereby to produce continued metal sheets. The contact height h or h' of the lower edge part of the control plate 2 or 2' which was determined on the basis of the point 11 or 11' of one roll 1 or 1' nearest to another roll 1' or 1 was set at 20~150 mm. Three kinds of control plates as shown in FIGS. 3(*a*), 3(*b*) and 3(*c*) were used as shapes of control plates 2 and 2'.

In addition, in order to form a molten metal pool at the clearance between the rolls 1 and 1' and ensure the control plates 2 and 2' a sufficient dip depth (about 5 to about 50 mm), side dams 6 were provided on both sides of rolls 1 and 1', as shown in FIGS.1 and 2. The thickness of the lower edge of each of control plates 2 and 2' and the roll surface speed were changed variously in the ranges of 1 to 10 mm and 0.15 to 1.4 m/sec, respectively, as operating conditions.

Figure 5:
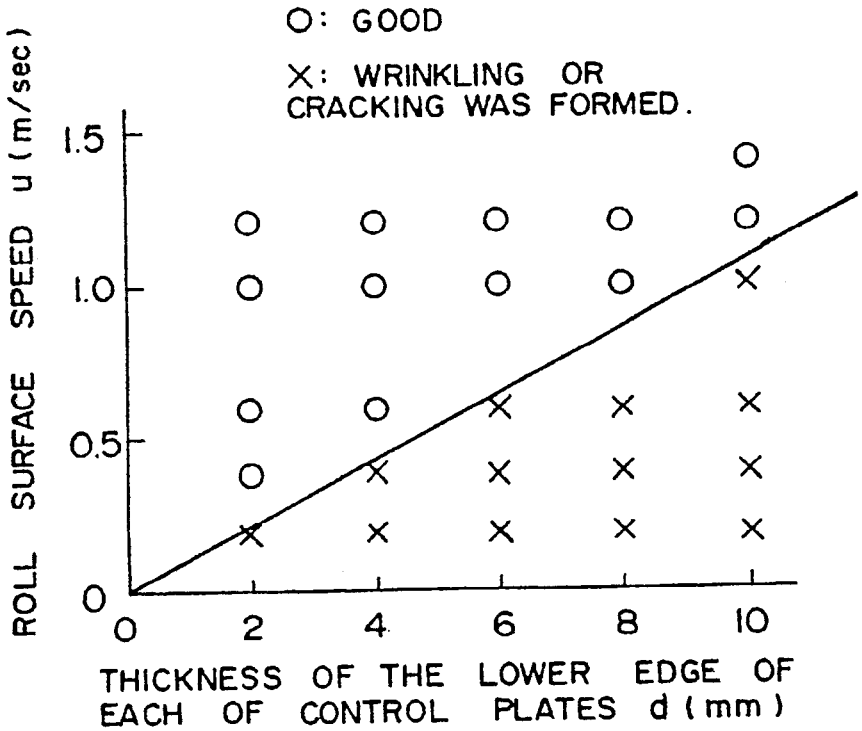
FIG. 5 is a diagram showing an influence of relations between the thickness of the lower edge of each of control plates and the roll surface speed upon the surface state of cast pieces of Fe-3 wt. % Si alloy.

Influences of relations between the thickness of the lower edges of control plates 2 and 2' and the roll surface speed upon the surface state of cast metal pieces are shown in FIG. 5. Under the condition for the roll surface speed u(m/sec) given below, cast metal pieces in a good surface state were obtained:

$$u \geqq d/9.5 \quad (3)$$

where d is a thickness of the lower edge of each of control plates 2 and 2' (mm).

Figure 7A:
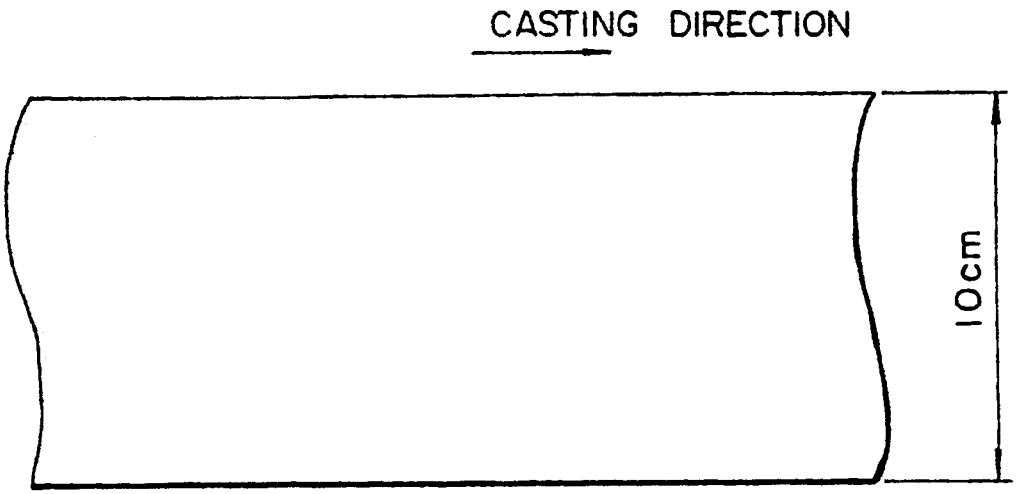
FIG. 7(*a*) is a sketch of a photograph showing the surface state of cast piece of Fe-3 wt. % Si alloy produced according to another example of the present invention.
Figure 7B:
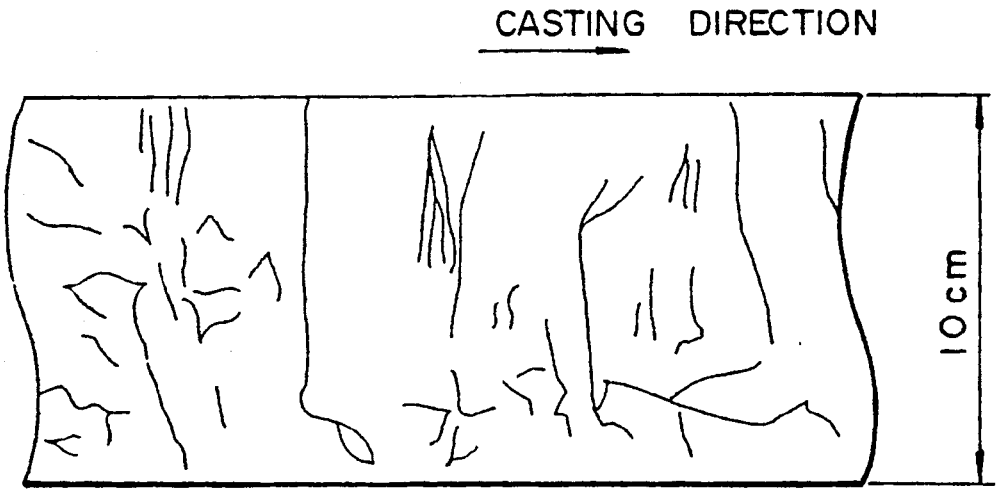

FIGS. 7(*a*) and 7(*b*) show sketches of photographs (scale: ½) showing the surface state of Fe-3 wt. % Si alloy cast pieces obtained in the above-mentioned tests. That is, FIG. 7(*a*) shows an example of cast metal piece with a flat and smooth surface, whereas FIG. 7(*b*) shows a comparative example of cast metal piece with a wrinkled surface. Under the casting condition satisfying the equation (3), cast metal pieces with a flat and smooth surface as shown in FIG. 7(*a*) were obtained.

As in the above-mentioned case of SUS304 steel, it was found that the dip angles $\theta$ and $\theta'$ of control plates h' of the lower edge part of the control plate 2 or 2' which was determined on the basis of the point 11 or 11' of one roll 1 or 1' nearest to another roll 1' or 1, the shapes of the lower edges of control plates 2 and 2', and the dip depth of control plates 2 and 2' had no effect upon the surface state of cast metal pieces.

From the foregoing test results, it was found that cast metal pieces in a good surface state were produced under the casting condition given by the following equation (1), that is, $$u \geqq d/a \quad (1)$$

wherein u is a roll surface speed (m/sec), d is a thickness of the lower edge of each of control plates (mm) and a is a coefficient depending upon the molten metal.

It is preferable that values of the coefficient a depending upon the species of molten metal are determined by changing the roll surface speed u in a range of speed of not more than 10 m/sec and the thickness of the lower edge of each of control plates in a range of thickness of not less than 1 mm. Because when the upper limit of the roll surface speed u exceeds 10 m/sec, the abrasion amount of the control plates becomes great. And when the control plates are composed of refractories or ceramics, it is difficult to process and form control plates such that a thickness of the lower edge is less than 1 mm.

By repeating the foregoing tests, values of the coefficient a depending upon the species of molten metals were obtained, as shown in the following Table.

TABLE

| Cast metal species | Values of coefficient a depending upon molten metal species |
|---|---|
| Fe-0.53 wt. % C | 4.5 |
| Fe-42 wt. % Ni | 6.0 |
| SUS304 | 6.3 |
| Fe-50 wt. % Cu | 8.5 |
| Fe-3 wt. % Si | 9.5 |

From the casting test results using molten metals of various cast metal species as shown in Table, it was presumed that generation of wrinkling or cracking on the surfaces of cast metal pieces was due to the shape and a range of fluctuation of a free molten metal surface 9 or 9' formed in the vicinity of the tip of each of control plates 2 and 2', as shown in FIG. 2. This can be understood by the fact that the wrinkling or cracking on the surfaces of cast pieces obtained by casting without using the control plates 2 and 2' was formed by fluctuation of the meniscus on the surface of molten metal pool.

By determining values of the coefficient a of molten metal species having various compositions in this manner, cast metal pieces with a good surface state can be obtained. As to other metal species than those given above, values of the coefficient a can be each determined simply by changing the roll surface speed and the thickness of the lower edge of each of control plates.

FIG. 2 is an enlarged view of the clearance between the rolls in FIG. 1, showing the free molten metal surfaces 9 and 9', formed in the vicinity of the tips of control plates 2 and 2'. The shapes of the free molten metal surfaces 9 and 9' and a range of fluctuation thereof depend upon the shapes of lower edges of control plates 2 and 2' (particularly thickness), the surface tension and viscosity of molten metal 5, the roll surface speed, etc.

In the present invention, when the lower edges of control plates 2 and 2' are in an angular form, the term "the thickness of the lower edge of each of control plates 2 and 2'" means a thickness d (mm) at the lower edge of each control plate as shown in FIGS. 3(*a*) and 3(*b*), but as shown in FIGS. 3(*c*) to 3(*f*), when the lower edges of control plates 2 and 2' are in the form of from a curve form to a sharpened form, the term "the thickness of the lower edge of each of control plates 2 and 2'" means a maximum thickness d (mm) at the lower edge of each control plate, and thus when the maximum thickness (d mm) at the lower edge of each control plate is determined, what form the lower edge of each control plate has is not related to the process of the present invention. In addition, the control plates 2 and 2' are provided in close contact with the roll surfaces at the flat parts of control plates 2 and 2', as shown in FIGS. 1 and 2.

EXAMPLES

Typical examples of the present invention will be given below:

(a) 8 kg of commercially available austenite system stainless steel (SUS304) was heated and melted in an Ar gas atmosphere in a melting furnace of high frequency induction heating type and adjusted to a temperature of 1,510° C., and then the molten metal was supplied to the clearance between a pair of rotating rolls, made of copper alloy (diameter: 300 mm and width: 100 mm), provided with control plates whose lower edge parts were in close contact with the roll surfaces, respectively, through a pouring nozzle in a slit form having an opening, 4 mm wide and 95 mm long, to produce continued metal sheets, about 0.7 to about 4 mm thick, about 10 cm wide and about 4 to about 10 m long. The control plates were made of an alumina system refractory and three kinds as shown in FIGS. 3(*a*), 3(*b*) and 3(*c*) were used as shapes of control plates. The dip depth of control plates was about 25 mm and the dip angles $\theta$ and $\theta'$ thereof were 0°, and the contact heights h and h' were 80 mm. As an operating variable, the roll surface speed was changed in a range of 0.15 to 1.4 m/sec, while keeping the thickness of the lower edge of each of control plates constant at 4 mm. As a result, cast metal pieces with a good surface state were obtained at a roll surface speed of about 0.64 m/sec or higher. From these data, it is determined that the coefficient a of SUS304 is equal to 6.3, as shown in the afore-mentioned formula (2).

FIG. 6(*a*) shows one example of a cast metal piece with a good surface state, which was under the conditions that the roll surface speed was 1.18 m/sec and the thickness of the lower edge of each of control plates was 2 mm.

FIG. 6(*b*) shows a comparative example of a cast metal piece with a wrinkled surface, which was cast under the conditions that the roll surface speed was 0.8 m/sec and the thickness of the lower edge of each of control plates was 6 mm.

(*b*) 8 kg of an alloy of Fe-3 wt. % Si and inevitable impurities was heated and melted in an in an Ar gas atmosphere in a melting furnace of high frequency induction heating type and adjusted to a temperature of 1,590° C., and then the molten metal was supplied to the clearance between a pair of rotating rolls, made of copper alloy (diameter: 300 mm and width: 100 mm), provided with control plates whose lower edge parts were in close contact with the roll surfaces, respectively, through a pouring nozzle in a slit form having an opening, 4 mm wide and 95 mm long, to produce continued metal sheets, about 0.8 to about 5 mm thick, about 10 cm wide and about 3 to about 10 m long. The control plates were made of an alumina system refractory and three kinds as shown in FIGS. 3(*a*), 3(*b*) and 3(*c*) were used as shapes of control plates. The dip depth of control plates was about 15 mm and the dip angles $\theta$ and $\theta'$ thereof were 45°, and the contact heights h and h' were 125 mm. The roll surface speed was changed in a range of 0.15 to 1.4 m/sec, while keeping the thickness of the lower edge of each of control plates constant at 2 mm. As a result, cast metal pieces with a good surface state were obtained at a roll surface speed of about 0.21 m/sec or higher. From these data, it is determined that the coefficient a of Fe-3 wt. % Si is equal to 9.5, as shown in the aforementioned formula (3).

FIG. 7(*a*) shows one example of a cast metal piece with a good surface state, which was cast under the conditions that the roll surface speed was 0.45 m/sec and the thickness of the lower edge of each of control plates was 3 mm.

FIG. 7(*b*) shows a comparative example of a cast metal piece with a wrinkled surface, which was cast under the conditions that the roll surface speed was 0.6 m/sec and the thickness of the lower edge of each of control plates was 6 mm.

What is claimed is:

1. A process for the twin-roll type, continuous casting of metal sheets, which comprises supplying a molten metal into the clearance between a pair of rolls, provided with control plates, respectively, solidifying the supplied molten metal and rolling the solidified molten metal, thereby producing cast pieces in a sheet form, the casting being carried out under a condition given by the following equation:

$$u \geqq d/a$$

wherein u is a roll surface speed (m/sec), d is a thickness of the lower edge of each of control plates (mm) and a is a coefficient depending upon the species of molten metal.

2. A process according to claim 1, wherein value of the coefficient a depending upon the species of molten metal is determined by changing the roll surface speed u (m/sec) and the thickness d (mm) of the lower edge of each of control plates.

3. A process according to claim 2, wherein the roll surface speed u is changed in a range of speed of not more than 10 m/sec and the thickness d (mm) of the lower edge of each of control plates is changed in a range of thickness of not less than 1 mm.

4. A process according to any one of claims 1 to 3, wherein a contact height h or h' of the lower edge part of the control plate, which is determined on the basis of a point of one roll nearest to another roll, is changed in a range specified by the following equation:

$$20 \text{ mm} \leqq h \text{ or } h' \geqq \text{radius of the roll.}$$

5. A process according to any one of claims 1 to 3, wherein the molten metal is selected from the group consisting of carbon steel, Fe-Ni system alloy, stainless steel, Fe-Cu system alloy and Fe-Si system alloy.

6. A process according to claim 4, wherein the molten metal is selected from the group consisting of carbon steel, Fe-Ni system alloy, stainless steel, Fe-Cu system alloy and Fe-Si system alloy.

* * * * *

UNITED STATES PATENT AND TRADEMARK OFFICE

CERTIFICATE OF CORRECTION

PATENT NO. : 5,065,812

DATED : November 19, 1991

INVENTOR(S) : Toshiaki MIZOGUCHI et al.

It is certified that error appears in the above-identified patent and that said Letters Patent is hereby corrected as shown below:

Col. 8, line 42, for "20 mm $\leq$h or h'$\geq$ radius of the roll", read --20 mm $\leq$ h or h' $\leq$ radius of the roll--.

Signed and Sealed this

First Day of June, 1993

*Attest:*

*Attesting Officer*

Michael K. Kirk

MICHAEL K. KIRK

*Acting Commissioner of Patents and Trademarks*